US005101187A

United States Patent [19]

Yuza

[11] Patent Number: 5,101,187

[45] Date of Patent: Mar. 31, 1992

[54] SUBMINIATURE FUSE AND METHOD OF MANUFACTURING SAME

[75] Inventor: Yasutada Yuza, Kanagawa, Japan

[73] Assignee: SOC Corporation, Tokyo, Japan

[21] Appl. No.: 527,730

[22] Filed: May 23, 1990

[30] Foreign Application Priority Data

Jun. 14, 1989 [JP] Japan ..... 1-68653[U]

[51] Int. Cl.[5] ..... H01H 85/38; H01H 85/143

[52] U.S. Cl. ..... 337/278; 337/255; 337/260; 337/282

[58] Field of Search ..... 337/255, 260, 264, 273, 337/278, 280, 282

[56] References Cited

U.S. PATENT DOCUMENTS

| | | | |
|---|---|---|---|
| 480,802 | 8/1892 | Bláthy | 337/278 |
| 4,401,963 | 8/1983 | Duenke . | |

FOREIGN PATENT DOCUMENTS

| | | | |
|---|---|---|---|
| 598624 | 5/1934 | Fed. Rep. of Germany | 337/278 |
| 3033529A1 | 4/1981 | Fed. Rep. of Germany . | |
| 8411586U1 | 8/1984 | Fed. Rep. of Germany . | |
| 3408854A1 | 9/1985 | Fed. Rep. of Germany . | |
| 878203 | 9/1961 | United Kingdom . | |

*Primary Examiner*—Harold Broome
*Attorney, Agent, or Firm*—Wenderoth, Lind & Ponack

[57] ABSTRACT

A subminiature fuse has a housing in which more than one enclosed arc-extinguishing chambers are in series provided with partitions inbetween and one or more than one small hole communicating with the more than one arc-extinguishing chambers in series are provided at the respective partitions, a pair of lead terminals being fixed to the housing in such a manner as the respective fuse wire connecting portions of the lead terminals are accommodated in the respective opposite end arc-extinguishing chambers and the portions of a pair of lead terminals for connection with an external circuit are projected out of the housing, a fuse wire being extended between the fuse wire connecting portions of the pair of lead terminals through the small hole of the respective partitions, the opposite ends of the fuse wire being electrically and mechanically connected respectively to the pair of the lead terminals, whereby the fuse is capable of providing a high breaking characteristics and quickly melting to sever the fuse wire upon flow of over-current without using arc-extinguishing material and causing less variation in the fusion time.

21 Claims, 2 Drawing Sheets

SUBMINIATURE FUSE AND METHOD OF MANUFACTURING SAME

BACKGROUND OF THE INVENTION

1. Technical Field

The present invention relates to a subminiature fuse.

2. Description of Prior Arts

In recent years, electronic appliances have become increasingly miniaturized and as a consequence, electric components constituting an electric circuit, for example, are also being considered for further miniaturization. Furthermore, in connection with withstand voltage, a high potential such as 200 V wiring is gradually becoming commonly accepted for household use and as a result miniature fuses which can be used in a range from a low voltage such as a few volts required for printed circuit boards to a high voltage exceeding AC 125 V are increasing in demand. Various sorts of miniature fuses have been developed in order to satisfy these requirements. As an example of miniature fuses which have been developed so far, there is available a type having the fuse wire completely embedded in resin to thereby easily attain miniaturization. However, a fuse of this sort suffers from drawbacks such that in the case of a relatively small overcurrent flowing therethrough due, for example, to failure of a transistor, Joule heat may be absorbed by the resin encircling the fuse wire resulting in a delay in the fusion time or the fuse may not melt until a sufficient number of elements are damaged to cause a flow of overcurrent high enough to melt the fuse. When a large current of a voltage exceeding AC 125 V is caused to flow due to short-circuiting or the like, since the fuse wire is entirely surrounded by resin, there is therefore nowhere room for metallic vapor generated by the melted, vaporized and expanded metallic component by the large current to be released. In consequence, the arcing time may be prolonged and the resin surrounding the fuse wire may be caused to shatter and scatter, thus causing potential hazard. In order to solve the problems as pointed out above, a miniature fuse has been developed wherein the area surrounding the fuse wire is filled with an arc-extinguishing material to thereby prevent the resin from being fractured by a large current. However, in the same manner as in the fuse as earlier mentioned, Joule heat may be absorbed by the arc-extinguishing material in the case of a small overcurrent and in this sense the problem that the fuse wire may not be melted away unless an excessively large current is caused to flow could not be entirely solved and the developed miniature current fuse as mentioned above was still not reliable.

SUMMARY OF THE INVENTION

Accordingly, an object of the present invention is to provide a subminiature fuse which is capable of solving the general problems as mentioned above, is very small in size but employs no arc-extinguishing material, provides a high breaking characteristic, protects the circuit and components when an abnormal current flows therethrough by quickly melting away the fuse wires with less variation in fusion time and is reliable.

A further object of the present invention is to provide a method of manufacturing the subminiature fuse mentioned above.

The objects of the present invention can be attained by a subminiature fuse comprising a housing having therein two enclosed arc-extinguishing chambers adapted to extinguish arcs and having also a small hole adapted to communicate the two arc-extinguishing chambers with each other, a pair of conductive terminal members secured to the housing and having opposite end portions, the end portions of the pair of terminal members extend outwardly from the outer surface of the housing so as to define the external connection adapted to be connected to an external electric circuit, and the other end portions of the pair of terminal members extend internally respectively into the two arc-extinguishing chambers in the housing. The subminiature fuse also includes a fusible element having opposite end portions and adapted to be respectively electrically and mechanically coupled to the other end portions of the pair of terminal members, whereby the circuit can be broken by extinguishing arcs without using arc-extinguishing material and variations of the pre-arcing time-current characteristics of the fuse can be reduced.

According to a preferred embodiment of this invention, the housing comprises an upper member having a recess and a partition partitioning the recess, and a lower member. A pair of conductive terminal members are secured to the lower member, the end portions of the pair of terminal members extending outwardly from the lower surface of the lower member to define an external connecting portion to be connected to an external electric circuit, the other end portions of the pair of terminal members extending from the upper surface of the lower member. The lower member is provided with a partition projecting upwardly from the upper surface of the lower member so as to partition the pair of terminal members. When the upper member is combined with the lower member with the recess of the upper member facing downwardly toward the upper surface of the lower member, the partition of the upper member is aligned with and abutted against the partition of the lower member to define the two enclosed arc-extinguishing chambers respectively accommodating each of a other end portions of the pair of terminal members and the small hole is provided at the partition constructed by the partitions of the upper and lower members so that the fusible element is allowed to pass through the small hole.

A lead frame is prepared by press working and has a comb-like configuration in which the ends of a plurality of terminal members are successively connected to the tip end portions of the respective teeth of the comb-like configuration. Each set of terminal members provided in the lead frame is secured to the lower member, each set comprising two terminal members, when the lower member is formed of resin by molding. Along the tip ends of a series of terminal members projecting from the upper surface of the lower member, there is extended an elongated fuse wire. The tip end portions of the terminal members are then folded in a manner to hold the fuse wire and subsequently firmly soldered therewith. Then the fuse wire is cut at the portion located between the adjacent terminal members of the respective adjacent sets of the terminal members. The upper member has a small semicircular groove at the center of the tip end of the partition and is combined with the lower member to the lower, and the abutting portions of the upper and lower members are welded together by means of ultrasonic welding. The tip ends of the partitions of the upper member and the lower member are welded, and the tip ends of the side walls defining the recess in the upper member are welded to the lower member. In this manner, two arc-extinguishing chambers are formed so as to respectively accommodate the end portions of the pair of terminal members to which the fuse wire is fixed. The fuse wire extended between the tip end portions of the pair of terminal members is held in a floating condition in the small semicircular groove portion provided at the partition of the upper member without contacting the partitions of the upper and lower members. With this arrangement, Joule heat will not be absorbed upon the occurrence of an overcurrent and the fuse wire can be melted away quickly. Even if, after the fuse wire has been melted away, an arc is generated, the metallic vapor which likely generates the arc will be confined in the small hole defined by the small semicircular groove. In this way, it is difficult for the arc to exist between the terminal members, and thus arc-extinguishing can be facilitated. Furthermore, the partition which partitions these two arc-extinguishing chambers serves to split the arc, so that the dielectric strength between the terminal members can be enhanced and restriking of the arc can be reduced. Upon completion of the welding of the upper and lower members, the ends of the terminal members at the side of the terminal members connected to the teeth of the comb-like configuration are cut to provide individual fuses.

According to another embodiment of this invention, which provides a fuse preferable for use for voltages equal to or exceeding AC 125 V, the distance between the terminal members as described in connection with the fuse mentioned above is made twice as long and one or more arc-extinguishing chambers are provided between the two arc-extinguishing chambers each of which accommodates one end portion of the pair of terminal members to which the fuse wire is fixed, so as to provide a higher breaking capability. It may be understood that since the comb-like lead frame having the terminal members connected in series is used for assembling the fuse, the steps of securing the terminal members to the lower member by molding, fixing the fuse wire to the tip end portions of the terminal members and welding the upper and lower members can be executed successively so that low cost mass-production can be attained.

These and further objects and advantages of the present invention may become apparent upon reading the description with reference to the accompanying drawings.

DESCRIPTION OF THE PREFERRED EMBODIMENTS

Figure 1:
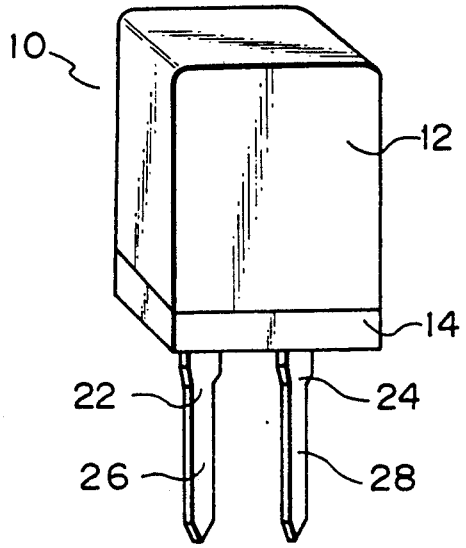
FIG. 1 is a perspective view of a subminiature fuse according to an embodiment of the present invention.

An embodiment of the present invention will now be described by referring to FIGS. 1 and 2. FIG. 1 is a perspective view of an embodiment of a subminiature fuse according to the present invention. The subminiature fuse is of a very compact construction having the size of approximately 5 mm (longitudinal×lateral) and approximately 6.5 mm (height).

Figure 2:
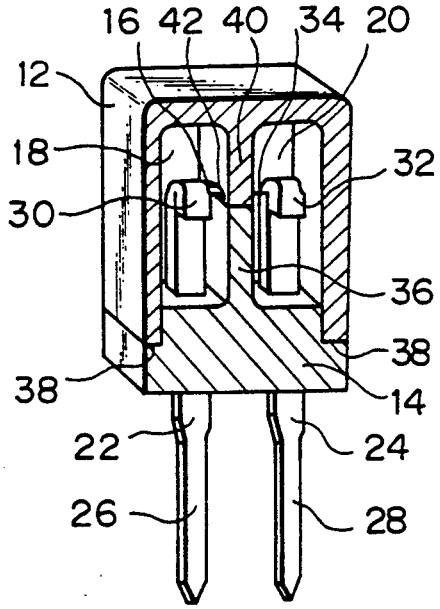
FIG. 2 is a cross-sectional perspective view of the subminiature fuse shown in FIG. 1.

FIG. 2 is a cross-sectional view of the subminiature fuse shown in FIG. 1 with a portion cut away to clearly show the internal construction thereof.

Referring to FIGS. 1 and 2, the housing 10 consists of the upper member 12 and the lower member 14. As explained in more detail, when these two members are combined, two arc-extinguishing chambers 18, 20 are defined in the housing 10, the chambers being communicated with each other through a small hole 16. A pair of lead terminals 22, 24 made of conductive material are embedded in the lower member 14 made of electrically insulating material. One ends of the lead terminals 22, 24 are projected from the lower side surface of the lower member 14 to provide the external connections 26, 28 adapted to be connected to the external electrical circuit, while the other ends of the lead terminals 22, 24 are projected from the upper side surface of the lower member 14 to provide the portions 30, 32 for connecting the fuse wire at the tip ends. The fuse wire 34 is stretched between the fuse wire connecting portions 30, 32 of the pair of lead terminals 22, 24. The opposite ends of the fuse wire 34 are electrically connected to the fuse connecting portions 30, 32 and mechanically secured thereto. The fuse wire connecting portions 30, 32 are preferably so constructed that the tip end portions are folded to hold the opposite end portions of the fuse wire thereby and then are firmly secured by soldering therebetween. The lower member 14 has a partition 36 which is projected upwardly from the central portion of the upper surface of the lower member 14 to partition the fuse wire connecting portions 30, 32 of the lead terminals 22, 24 and whose tip end surface extends to a height slightly lower than a height of the stretched fuse wire 34, so as not to touch the fuse wire 34. A stepped portion 38 is provided at a side surface of the lower member 14. It is preferable for the lower member 14 to be formed of resin by molding and at the same time the central portions of the lead terminals 22 and 24 are embedded in the lower member 14.

The upper member 12 includes a recess and a partition 40 extending downwardly from the top inner surface of the recess to partition the recess into two parts. A small groove 42 whose shape is semicircular in section is provided centrally at the tip end surface of the partition 40. When the upper and lower members 12, 14 are combined with the recess of the upper member 12 facing toward the side of the lower member 14 on which the fuse wire connecting portions 30, 32 of the lead terminals 22, 24 are projected, an inner chamber is defined in the housing, the tip ends of the side walls defining the recess of the upper member 12 are fit against the stepped portions 38, and the partition 40 of the upper member 12 is aligned with the partition 36 of the lower member 14, so that the tip end surfaces of both partitions 36, 40 may abut with each other. The upper member 12 is constructed in this manner. After the upper member 12 and the lower member 14 are combined in the manner as explained above, the tip end of the side walls defining the recess of the upper member 12, and the stepped portions 38 of the lower member 14 as well as the abutted surfaces of the partitions 36, 40 of the upper member 12 and the lower member 14 are welded together by means of ultrasonic welding. In this way, there are provided the arc-extinguishing chambers 18, 20 adapted to accommodate each of the fuse wire connecting portions 30, 32 of the lead terminals 22, 24, and a small hole 16 of semi-circular configuration in section is formed by the groove 42 in the upper member 12 and a part of the tip end surface of the partition 36 of the lower member 14. The fuse wire 34 extends through the small hole 16 without contacting the inner wall of the hole 16 and is held in a floating condition. Owing to the construction as described above in which the fuse wire 34 is held in a floating condition without contacting the upper member 12 and the lower member 14, even when a slight abnormal current flows through the fuse wire 34, Joule heat may not be absorbed by the upper member 12 and the lower member 14, so that the fuse may be quickly melted and severed so as to safely protect the external components and circuit from abnormal current. Furthermore, even if a large current exceeding AC 125 V causes arc, such an arc may be split by the partition made up of the partitions 36, 40 of the upper member 12 and the lower member 14 so that the dielectric strength may be enhanced and a high breaking capability may be attained.

Figure 3:
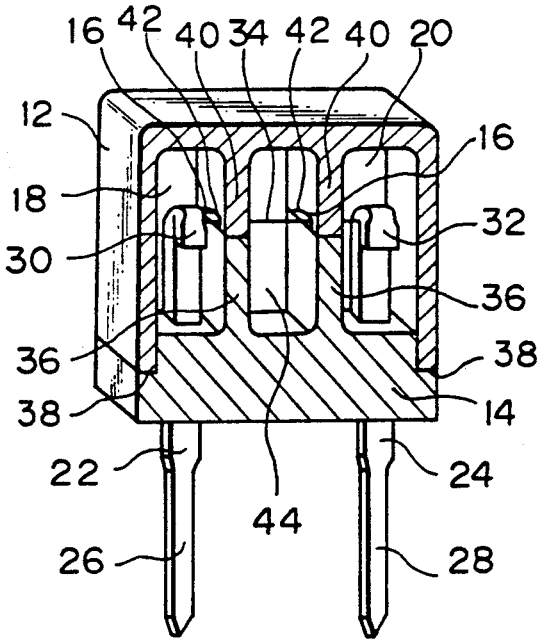
FIG. 3 is a cross-sectional perspective view of a subminiature fuse according th another embodiment of the present invention.

FIG. 3 is a cross-sectional view of a subminiature fuse to be used for the circuit using a voltage over AC 125 V. Similar components to those explained with reference to FIG. 2 are denoted with the same numerals. The difference compared to the embodiment shown in FIG. 2 resides in that another arc-extinguishing chamber 44 is disposed between two partitions for the arc-extinguishing chambers 18, 20 adapted to accommodate each of the fuse wire connecting portions 30, 32 of the lead terminals 22, 24, whereby a higher breaking capability may be further attained.

Figure 4:
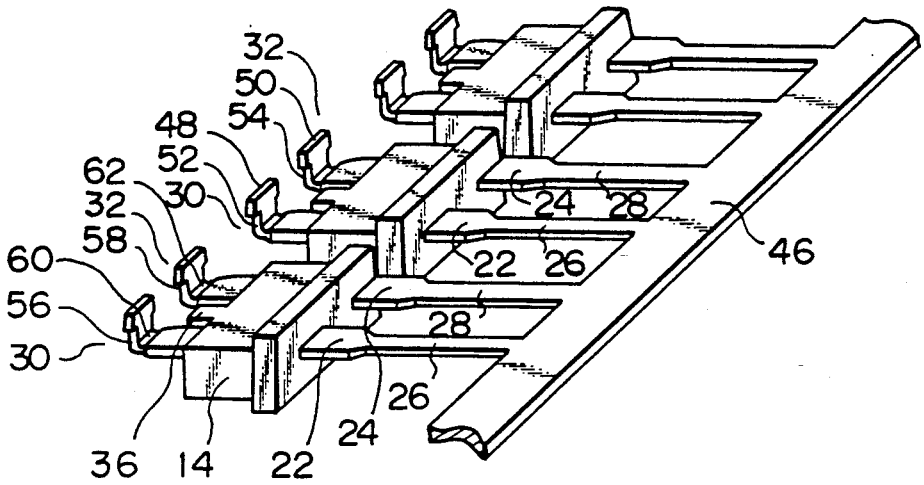
FIG. 4 and FIG. 5 illustrate a manner assembling the subminiature fuse shown in FIG. 1 through FIG. 3 according to the embodiments of the present invention.
Figure 5:
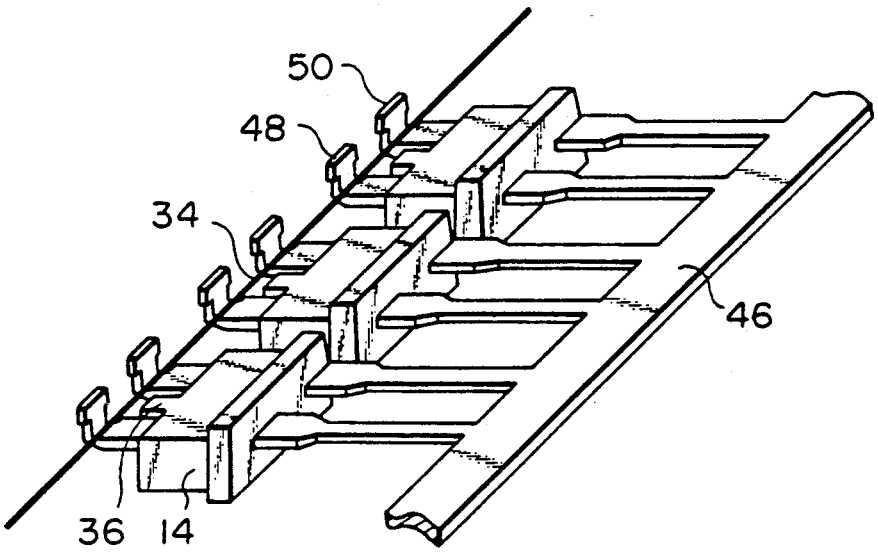

FIGS. 4 and 5 illustrate a part of the assembly procedure for the fuse according to the above-mentioned embodiment of the present invention. A lead frame 46 which has a comb-like configuration in which the external connecting portions 26, 28 of a plurality of lead terminals 22, 24 are connected in series at the tip ends of the respective teeth of the lead frame 46 of a comb-like configuration is first prepared by pressing work. The tip ends 48, 50 of the fuse wire connecting portions 30, 32 adapted to securely fasten the fuse wire 34 of the lead terminals 22, 24 are folded in "L"-shaped condition in advance by the pressing work. The opposite sides of bent portions 52, 54 are provided with narrowed portions 56, 58 to facilitate the folding work. At central locations of these narrowed portions 56, 58, there are formed grooves 60, 62 which are provided so as to protect the fuse wire 34 from being damaged when the L-shaped tip ends 48, 50 of the fuse wire connecting portions 30, 32 are folded around the fuse wire 34 and pressed to contact with the fuse wire 34. The L-shaped bending portions 52, 54 are bent into a "U" configuration to hold the fuse wire 34 therein after accommodating the fuse wire 34 and firmly fixed by soldering applied thereon. Stretching, fixing and assembling of the fuse wire 34 may be executed by using a continuous lead frame, whereby mass-production may be attained. Subsequently, the respective portions of the fuse wire 34 which extend between the terminal members which are fixed by molding respectively to the adjacent lower members are cut down. The upper member 12 is fit with the lower member 14 with the recess of the upper member 12 facing toward the side of the lower member 14 where the fuse wire 34 is fixed, and the abutting portions of the upper member 12 and the lower member 14 are then welded together by ultrasonic welding. Then, the ends of the external connecting portions 26, 28 of the terminal members 22, 24 continuously connected to the comb teeth of the lead frame 46 of comb-like configuration are severed to provide individual fuses.

Instead of providing the groove 42 on the partition 40 of the upper member 12, the groove may be provided on the partition 36 of the lower member 14 or on both partitions 36, 40 of the lower and upper members 14, 12.

As explained above, the present invention is capable of providing excellent fusion characteristics with high breaking capability at a high voltage of more than AC 125 V, and less variance in fusion time by providing arc-extinguishing chambers, and is also capable of attaining mass-production.

What is claimed is:

1. A subminiature fuse comprising:

a housing having an inner chamber formed therein, and including a partition wall therein dividing said inner chamber into two arc-extinguishing chambers, said partition wall having a small hole formed therethrough communicating between said two arc-extinguishing chambers;

a pair of conductive terminals secured to said housing and having respective inner and outer end portions, said terminals extending through said housing such that said outer end portions extend outwardly of said housing and define external connecting portions adapted to be connected to an external electric circuit and such that said inner end portions extend, respectively, into said two arc-extinguishing chambers;

a fusible element having opposite end portions electrically and mechanically connected, respectively, to said inner end portions of said pair of terminal members, said fusible element extending through said small hole in said partition wall such that said fusible element does not contact a peripheral wall of said small hole;

wherein said arc-extinguishing chambers are substantially devoid of any arc-extinguishing material in contact with said fusible element; and wherein said inner end portions of said pair of terminal members are disposed substantially at the centers of said two arc-extinguishing chambers, respectively, so that said inner end portions are spaced from said small hole by a sufficient distance to allow said small hole to extinguish an arc, and said small hole has a cross-sectional area which is sufficiently small to extinguish an arc, such that said small hole defines a means for extinguishing an arc between said inner end portions of said pair of terminal members.

2. A subminiature fuse as recited in claim 1, wherein said housing further includes an additional partition wall having an additional small hole formed therethrough, and further dividing said inner chamber so as to form at least one additional arc-extinguishing chamber therein.

3. A subminiature fuse as recited in claim 2, wherein said fusible element further extends through said additional small hole without contacting a peripheral wall thereof.

4. A subminiature fuse as recited in claim 1, wherein said housing is formed of resin material.

5. A subminiature fuse as recited in claim 4, wherein said pair of terminals are molded into said housing.

6. A subminiature fuse as recited in claim 1, wherein said housing includes an upper member having a recess formed therein, and a lower member, said upper and lower members being mutually connected so as to define said inner chamber.

7. A subminiature fuse as recited in claim 6, wherein said upper member includes an upper partition portion and said lower member includes a lower partition portion, said upper and lower partition portions being in abutting relationship to form said partition wall.

8. A subminiature fuse as recited in claim 7, wherein said small hole formed through said partition wall is defined by a groove formed in an end of one of said upper and lower partition portions.

9. A subminiature fuse as recited in claim 8, wherein said groove has a semicircular cross section.

10. A subminiature fuse as recited in claim 1, wherein said arc-extending chambers are devoid of arc-extinguishing material.

11. A subminiature fuse as recited in claim 1, wherein said fusible element extends respectively between said inner end portions of said pair of terminal members in a substantially linear manner.

12. A subminiature fuse as recited in claim 1, wherein said subminiature fuse is approximately 5 mm wide, 5 mm thick, and 6.5 mm high, and said housing is formed of resin material.

13. A subminiature fuse as recited in claim 12, wherein said housing further includes an additional partition wall having an additional small hole formed therethrough, and further dividing said inner chamber so as to form at least one additional arc-extinguishing chamber therein.

14. A subminiature fuse as recited in claim 13, wherein said fusible element further extends through said additional small hole without contacting a peripheral wall thereof.

15. A subminiature fuse as recited in claim 12, wherein said pair of terminals are molded into said housing.

16. A subminiature fuse as recited in claim 12, wherein said housing includes an upper member having a recess formed therein, and a lower member, said upper and lower members being mutually connected so as to define said inner chamber.

17. A subminiature fuse as recited in claim 16, wherein said upper member includes an upper partition portion and said lower member includes a lower partition portion, said upper and lower partition portions being in abutting relationship to form said partition wall.

18. A subminiature fuse as recited in claim 17, wherein said small hole formed through said partition wall is defined by a groove formed in an end of one of said upper and lower partition portions.

19. A subminiature fuse as recited in claim 18, wherein said groove has a semicircular cross section.

20. A subminiature fuse as recited in claim 12, wherein said arc-extending chambers are devoid of arc-exthinguishing material.

21. A subminiature fuse as recited in claim 12, wherein said fusible element extends respectively between said inner end portions of said pair of terminal members in a substantially linear manner.

* * * * *